US011814274B2

(12) United States Patent
Yasukochi

(10) Patent No.: US 11,814,274 B2
(45) Date of Patent: Nov. 14, 2023

(54) FORKLIFT

(71) Applicant: Mitsubishi Logisnext Co., Ltd., Kyoto (JP)

(72) Inventor: Hidekazu Yasukochi, Nagaokakyo (JP)

(73) Assignee: Mitsubishi Logisnext Co., Ltd., Kyoto (JP)

( * ) Notice: Subject to any disclaimer, the term of this patent is extended or adjusted under 35 U.S.C. 154(b) by 382 days.

(21) Appl. No.: 17/276,909

(22) PCT Filed: Dec. 27, 2018

(86) PCT No.: PCT/JP2018/048256
§ 371 (c)(1),
(2) Date: Mar. 17, 2021

(87) PCT Pub. No.: WO2020/136830
PCT Pub. Date: Jul. 2, 2020

(65) Prior Publication Data

US 2021/0371261 A1 Dec. 2, 2021

(51) Int. Cl.
*B66F 9/075* (2006.01)
*B66F 17/00* (2006.01)
*B66F 9/24* (2006.01)

(52) U.S. Cl.
CPC ..... *B66F 9/0759* (2013.01); *B66F 9/0755* (2013.01); *B66F 9/07568* (2013.01); *B66F 9/24* (2013.01)

(58) Field of Classification Search
CPC .. B66F 9/0759; B66F 9/0755; B66F 9/07568; B66F 9/24; B66F 17/003
(Continued)

(56) References Cited

U.S. PATENT DOCUMENTS 5,921,340 A * 7/1999 Abels ..... B60N 2/38 180/326
6,446,758 B1 * 9/2002 Schatz ..... B66F 9/0759 297/335
(Continued)

FOREIGN PATENT DOCUMENTS

CN 108290726 A 7/2018
DE 10 2017 205 110 A1 9/2018
(Continued)

OTHER PUBLICATIONS

Chinese Office Action for Chinese Application No. 201880099530.2, dated Jun. 10, 2022. (Partial Translation).
(Continued)

*Primary Examiner* — Jaime Figueroa
(74) *Attorney, Agent, or Firm* — BLANK ROME LLP

(57) ABSTRACT

A forklift includes: an armrest that is provided at a driver's seat of a vehicle and is moved between a non-operation position and an operation position by a movable mechanism; a steering member that outputs an operation signal in response to a steering operation; a steering device that changes a steering angle of steering wheels of the vehicle; a control unit that changes the steering angle according to the operation signal; and an armrest detection unit that detects whether the armrest is at the non-operation position or at the operation position in which when the armrest detection unit detects that the armrest is at the non-operation position, the control unit controls the steering device or the steering member such that the steering device does not change the steering angle even if the steering member is operated.

11 Claims, 9 Drawing Sheets

(58) Field of Classification Search
USPC ..... 701/1, 50
See application file for complete search history.

(56) References Cited

U.S. PATENT DOCUMENTS

| | | | | |
|---|---|---|---|---|
| 6,695,567 | B2 * | 2/2004 | Nagata | F15B 11/17 414/635 |
| 6,827,174 | B2 * | 12/2004 | Chernoff | B62D 1/12 180/402 |
| 6,880,855 | B2 * | 4/2005 | Chernoff | B60W 30/18181 74/552 |
| 7,059,680 | B2 * | 6/2006 | Billger | B60N 2/919 297/344.21 |
| 7,121,608 | B2 * | 10/2006 | Billger | B60N 2/38 297/344.22 |
| 7,347,299 | B2 * | 3/2008 | Billger | B66F 9/07545 180/326 |
| 7,374,004 | B2 * | 5/2008 | Kraimer | B60K 1/04 180/68.5 |
| 7,438,318 | B2 * | 10/2008 | Sano | B60N 2/753 180/326 |
| 7,827,630 | B2 * | 11/2010 | Bostelman | A61G 7/1088 5/83.1 |
| 8,210,613 | B2 * | 7/2012 | Adelsperger | B66F 9/0759 297/344.21 |
| 8,235,161 | B2 * | 8/2012 | Passeri | B66F 9/07568 180/326 |
| 8,356,688 | B2 * | 1/2013 | Passeri | B62D 51/002 180/326 |
| 9,707,865 | B1 * | 7/2017 | Buerkle | B60N 2/38 |
| 10,754,466 | B2 * | 8/2020 | Ochenas | B66F 9/0755 |
| 11,427,450 | B2 * | 8/2022 | Stilwell | B66F 9/07572 |
| 11,603,299 | B2 * | 3/2023 | O'Keeffe | B66F 17/003 |
| 2001/0030085 | A1 * | 10/2001 | Nagata | B66F 9/22 187/222 |
| 2004/0129486 | A1 * | 7/2004 | Chernoff | B60T 7/08 180/315 |
| 2004/0129488 | A1 * | 7/2004 | Chernoff | B60T 7/02 180/333 |
| 2004/0140145 | A1 * | 7/2004 | Chernoff | B60T 7/08 180/315 |
| 2005/0257973 | A1 * | 11/2005 | Szymanski | B66F 9/20 180/68.5 |
| 2006/0061122 | A1 * | 3/2006 | Billger | B66F 9/0759 296/65.07 |
| 2007/0017728 | A1 * | 1/2007 | Sano | B60N 2/77 180/326 |
| 2007/0074923 | A1 * | 4/2007 | Billger | B66F 9/0759 187/222 |
| 2008/0066988 | A1 | 3/2008 | Asp et al. | |
| 2009/0144895 | A1 * | 6/2009 | Bostelman | A61G 7/109 5/87.1 |
| 2010/0072801 | A1 * | 3/2010 | Adelsperger | B60N 2/797 297/344.21 |
| 2015/0034424 | A1 | 2/2015 | Kaneko | |
| 2018/0143734 | A1 * | 5/2018 | Ochenas | H04L 12/40 |
| 2019/0367341 | A1 * | 12/2019 | Stilwell | B66F 9/0759 |
| 2023/0174359 | A1 * | 6/2023 | Stilwell | B66F 9/0759 180/65.1 |

FOREIGN PATENT DOCUMENTS

| | | | |
|---|---|---|---|
| EP | 2 511 224 | A1 | 10/2012 |
| EP | 2 674 387 | A1 | 12/2013 |
| GB | 2561828 | A | 10/2018 |
| JP | 60-130140 | U | 8/1985 |
| JP | 61-129347 | A | 6/1986 |
| JP | 9-215116 | A | 8/1997 |
| JP | 10-131235 | A | 5/1998 |
| JP | 10-252100 | A | 9/1998 |
| JP | 10-310388 | A | 11/1998 |
| JP | 2000-118275 | A | 4/2000 |
| JP | 2000-142274 | A | 5/2000 |
| JP | 2000-143192 | A | 5/2000 |
| JP | 2000-264113 | A | 9/2000 |
| JP | 2002-87776 | A | 3/2002 |
| JP | 2004-269067 | A | 9/2004 |
| JP | 2005-170180 | A | 6/2005 |
| JP | 2006-321603 | A | 11/2006 |
| JP | 2007-244320 | A | 9/2007 |
| JP | 2010-505676 | A | 2/2010 |
| JP | 2013-184669 | A | 9/2013 |
| JP | 2013-204376 | A | 10/2013 |
| JP | 2015-040081 | A | 3/2015 |
| JP | 2016-84002 | A | 5/2016 |
| JP | 6103614 | B1 | 3/2017 |
| KR | 10-2007-0068945 | A | 7/2007 |
| WO | WO 2013/160984 | A1 | 10/2013 |

OTHER PUBLICATIONS

European Search Report for European Application No. 18944130.6, dated Jul. 18, 2022.
Japanese Office Action for Japanese Application No. 2017-127382, dated May 6, 2021.
International Search Report for International Application No. PCT/JP2018/048256, dated Feb. 19, 2019.
International Preliminary Report on Patentability for International Application No. PCT/JP2018/048256, dated Oct. 8, 2019.

* cited by examiner

FORKLIFT

RELATED APPLICATIONS

This application is a national stage filing under 35 U.S.C. § 371 of international application number PCT/JP2018/048256, filed Dec. 27, 2018, which is herein incorporated by reference in its entirety.

TECHNICAL FIELD

The present invention relates to a forklift.

BACKGROUND ART

In counterbalance type forklifts, it is required to improve front visibility. On the other hand, in reach type forklifts, there is known an example of the related art provided with a by-wire type steering member (hereinafter referred to as a mini-steering) instead of a steering wheel (Patent Document 1).

CITATION LIST

Patent Document

[Patent Document 1]
European Patent Application, Publication No. 2674387

SUMMARY OF INVENTION

Technical Problem

In order to improve the front visibility of the counterbalance type forklift, one measure is to adopt a mini-steering as in the reach type forklift described above. However, in a case where a steering wheel in front of a driver's seat of the counterbalance type forklift is abolished and the mini-steering is provided at a location other than the front of the driver's seat, it is necessary to secure safety equal to or higher than in a case where the steering wheel is provided in front of the driver's seat.

Solution to Problem (1) A forklift according to a first aspect of the present invention includes; an armrest that is provided at a driver's seat of a vehicle and is moved between a non-operation position and an operation position by a movable mechanism; a steering member that is provided on the armrest and outputs an operation signal in response to a steering operation; a steering device that changes a steering angle of steering wheels of the vehicle; a control unit that electrically transmits the operation signal from the steering member to the steering device to change the steering angle according to the operation signal; and an armrest detection unit that detects whether the armrest is at the non-operation position or at the operation position, in which when the armrest detection unit detects that the armrest is at the non-operation position, the control unit controls the steering device or the steering member such that the steering device does not change the steering angle even if the steering member is operated.

(2) According to a forklift of a second aspect of the present invention, in the forklift according to the first aspect, the armrest detection unit detects a first position where the armrest supports an aim of an operator as the operation position, and detects a second position different from the first position as the non-operation position.

(3) According to a forklift of a third aspect of the present invention, in the forklift according to the first or second aspect, when the armrest detection unit detects that the armrest is at the non-operation position, the control unit controls the steering member so as not to transmit the operation signal to the steering device or output the operation signal, such that the steering device does not change the steering angle.

(4) According to a forklift of a fourth aspect of the present invention, in the forklift according to the first to third aspects, the forklift further includes a seating detection unit that detects whether or not an operator is seated in the driver's seat, in which when the seating detection unit detects that the operator is not seated, the control unit controls the steering member so as not to transmit the operation signal to the steering device or output the operation signal, such that the steering device does not change the steering angle even if the armrest detection unit detects that the armrest is at the operation position and the steering member is operated.

(5) According to a forklift of a fifth aspect of the present invention, in the forklift according to the first to fourth aspects, the forklift further includes: a cargo handling information output unit that outputs cargo handling operation information in response to a cargo handling operation; and a cargo handling device that drives a fork, based on the cargo handling operation information, in which the control unit electrically transmits the cargo handling operation information from the cargo handling information output unit to the cargo handling device to drive the fork according to the cargo handling operation information, and when the armrest detection unit detects that the armrest is at the non-operation position, the control unit controls the cargo handling device or the cargo handling information output unit such that the cargo handling device does not drive the fork even if the cargo handling operation is performed.

(6) According to a forklift of a sixth aspect of the present invention, in the forklift according to the fifth aspect, the cargo handling information output unit outputs the cargo handling operation information in response to a lifting operating or a tilting operating.

(7) According to a forklift of a seventh aspect of the present invention, in the forklift according to the fifth or sixth aspect, the control unit controls the cargo handling information output unit so as not to transmit the cargo handling operation information to the cargo handling device or output the cargo handling operation information, such that the cargo handling device does not drive the fork even if the cargo handling operation is performed.

(8) According to a forklift of an eighth aspect of the present invention, in the forklift according to the first to seventh aspects, the forklift further includes: a traveling information output unit that outputs traveling operation information in response to a traveling operation; and a traveling device that drives drive wheels of the vehicle, based on the traveling operation information, in which the control unit electrically transmits the traveling operation information from the traveling information output unit to the traveling device to drive the drive wheels according to the traveling operation information, and when the armrest detection unit detects that the armrest is at the non-operation position, the control unit controls the traveling device or the traveling information output unit such that the traveling device does not drive the drive wheels even if the traveling operation is performed.

(9) According to a forklift of a ninth aspect of the present invention, in the forklift according to the eighth aspect, the control unit controls the traveling information output unit so as not to transmit the traveling operation information to the traveling device or output the traveling operation information, such that the traveling device does not drive the drive wheels even if the traveling operation is performed.

(10) According to a forklift of a tenth aspect of the present invention, in the forklift according to the first to ninth aspects, a handrail provided in front of the driver's seat and protruding toward the driver's seat is disposed at a space position higher than a seat surface of the driver's seat.

(11) According to a forklift according to an eleventh aspect of the present invention, in the forklift according to the first to tenth aspects, the armrest supports an operator's body when the vehicle falls sideways.

(12) A forklift according to a twelfth aspect of the present invention includes: a steering member that is provided at a location other than a front of an operator seated in a driver's seat of a vehicle and outputs an operation signal in response to a steering operation; a steering device that changes a steering angle of steering wheels of the vehicle; a control unit that electrically transmits the operation signal from the steering member to the steering device to change the steering angle according to the operation signal; and a handrail provided in the front, protruding toward the driver's seat, and disposed at a space position higher than a seat surface of the driver's seat.

(13) According to a forklift of a thirteenth aspect of the present invention, in the forklift according to the twelfth aspect, the forklift further includes: an armrest that is provided at the driver's seat, is movable between a non-operation position and an operation position by a movable mechanism, and includes the steering member; and an armrest detection unit that detects whether the armrest is at the non-operation position or at the operation position, in which when the armrest detection unit detects that the armrest is at the non-operation position, the control unit controls the steering device or the steering member such that the steering device does not change the steering angle even if the steering member is operated.

(14) According to a forklift of a fourteenth aspect of the present invention, in the forklift according to the thirteenth aspect, the armrest detection nit detects a first position where the armrest supports an arm of an operator as the operation position, and detects a second position different from the first position as the non-operation position.

(15) According to a forklift of a fifteenth aspect of the present invention, in the forklift according to the thirteenth or fourteenth aspect, when the armrest detection unit detects that the armrest is at the non-operation position, the control unit controls the steering member so as not to transmit the operation signal to the steering device or output the operation signal, such that the steering device does not change the steering angle.

(16) According to a forklift of a sixteenth aspect of the present invention, in the forklift according to the thirteenth to fifteenth aspects, the armrest supports an operator's body when the vehicle falls sideways.

Advantageous Effects of Invention

According to the forklift according to the present invention, the front visibility can be improved and safety can be secured.

DESCRIPTION OF EMBODIMENTS

Hereinafter, a forklift according to an embodiment of the present invention will be described with reference to the drawings.

<Overall Configuration>

Figure 1:
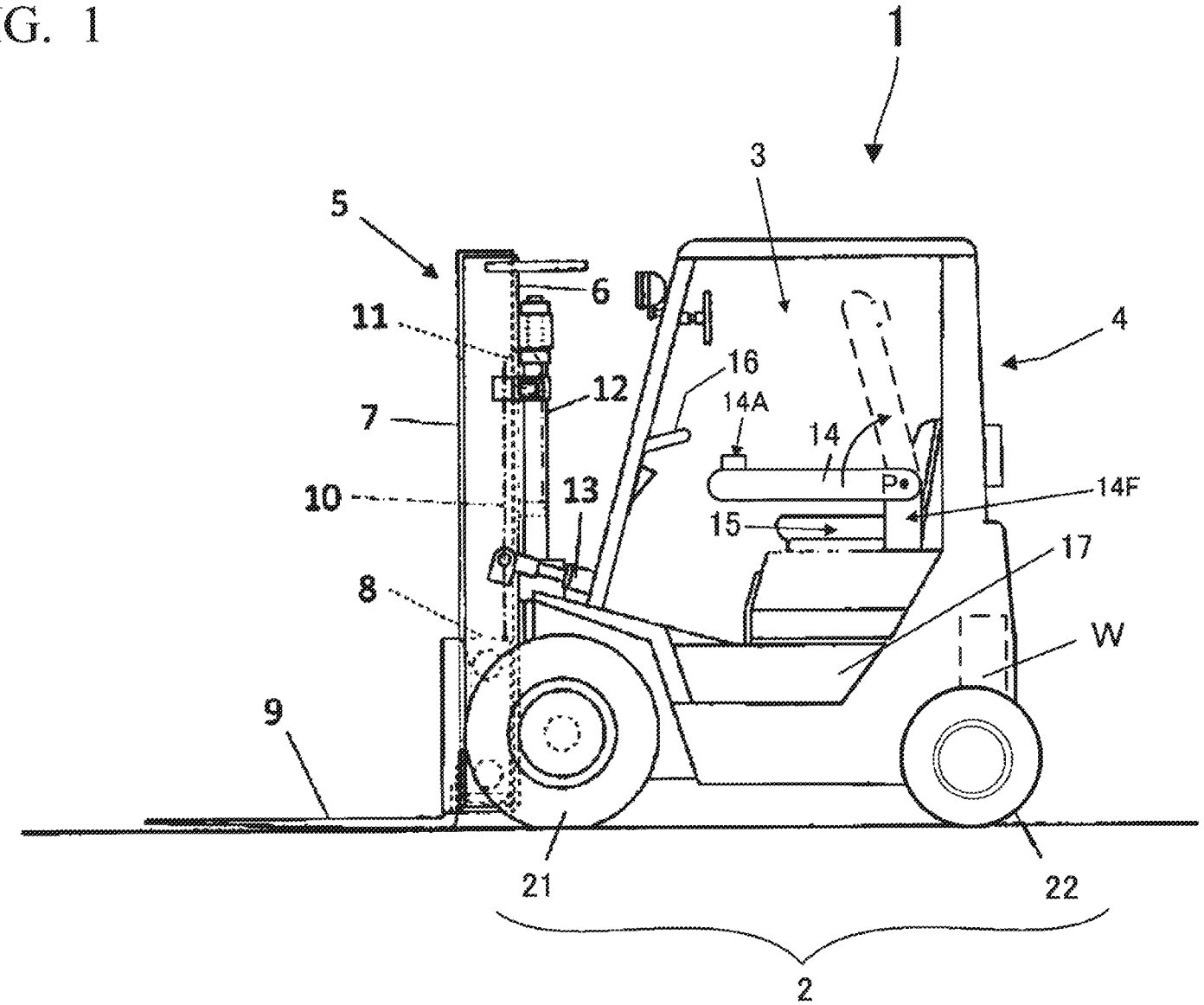
FIG. 1 is a side view showing a counterbalance type forklift.

FIG. 1 is a side view showing a counterbalance type forklift 1. The left side of FIG. 1 is a front part of the forklift 1, and the right side of FIG. 1 is a rear part of the forklift 1. The forklift 1 has a vehicle main body 4 provided with traveling wheels 2 and a driver's cab 3, and a cargo handling device 5 provided at a front part of the vehicle main body 4. The cargo handling device 5 includes a pair of right and left outer masts 6 fixed to the front part of the vehicle main body 4, a pair of right and left inner masts 7 which is supported and guided by the outer masts 6 to be movable up and down, a carriage 8 that is an elevating body disposed at the inner masts 7 so as to be movable up and down, and a pair of right and left forks 9 provided on the front surface side of the carriage 8 to hold cargo.

A chain 10 is provided over the carriage 8 and the outer masts 6, and a middle portion of the chain 10 is wound around sheaves 11, which are guide wheels provided at upper portions of the inner masts 7, to suspend the carriage 8. The inner masts 7 are moved up and down by lift cylinders 12 fixedly supported on the outer masts 6. Therefore, when the inner masts 7 are moved up, and down by the lift cylinders 12, the carriage 8 and the forks 9 provided at the carriage 8 are moved up and down through the chain 10 by the moving-up and down of the sheaves 11.

Both the lift cylinders 12 and the chain 10 are disposed on the right and left sides of the outer masts 6. Further, tilt cylinders 13 for tilting the outer masts 6 in a front-rear direction are provided between the outer masts 6 and the vehicle main body 4.

The forklift according to this embodiment is a forklift provided with a standard two-stage mast. However, the embodiment of the present invention is not necessarily limited to that, and a forklift provided with a three-stage mast or a forklift provided with a full free mast may be adopted. In particular, in the case of the forklift provided with a full free mast, a cylinder for moving the carriage 8 up and down is separately provided at the front part of the vehicle main body 4, and the cylinder may further obstruct front visibility.

A counterweight W is accommodated in the rear part of the vehicle main body 4. Further, a storage part 17 for accommodating a battery, a motor, a VCM (Vehicle Control Module), and the like, which will be described later, is provided in the interior of the vehicle main body 4.

The driver's cab 3 is provided with a driver's seat 15 and a plurality of operation members which are operated by an operator (not shown). The driver's seat 15 is provided with an armrest 14. In the armrest 14, for example, a base 14F (FIG. 3), which will be described later, is fixed to a seat of the driver's seat 15 and is supported to be rotatable, with a point P as the center. The armrest 14 is configured to be rotatable in the direction of an arrow from the position of a solid line, which is a use position. The position of the armrest 14 shown by a solid line is also referred to as an operation position. The operator moves the armrest 14 up and down to flip up it as shown by a broken line. The position of the flipped up armrest 14 is referred to as a non-use position or a non operation position.

A mini-steering 14A, which is one of the operation members, is provided at an upper portion of the tip of the armrest 14 that is at the use position. The mini-steering 14A is an operation member which is used for steering the forklift 1.

A safety bar 16 is provided in front of the driver's seat 15 (in an advance direction of the forklift 1). The safety bar 16 is provided as a handrail that the operator in the driver's cab 3 grasps in order to support the body, for example, in a case where the forklift 1 is tilted forward, or the like. The structural strength of the safety bar 16 is calculated in consideration of a load by the operator. Therefore, for example, even in a case where the forklift 1 is likely to fall forward, it is possible to safely support the operator.

Figure 2:
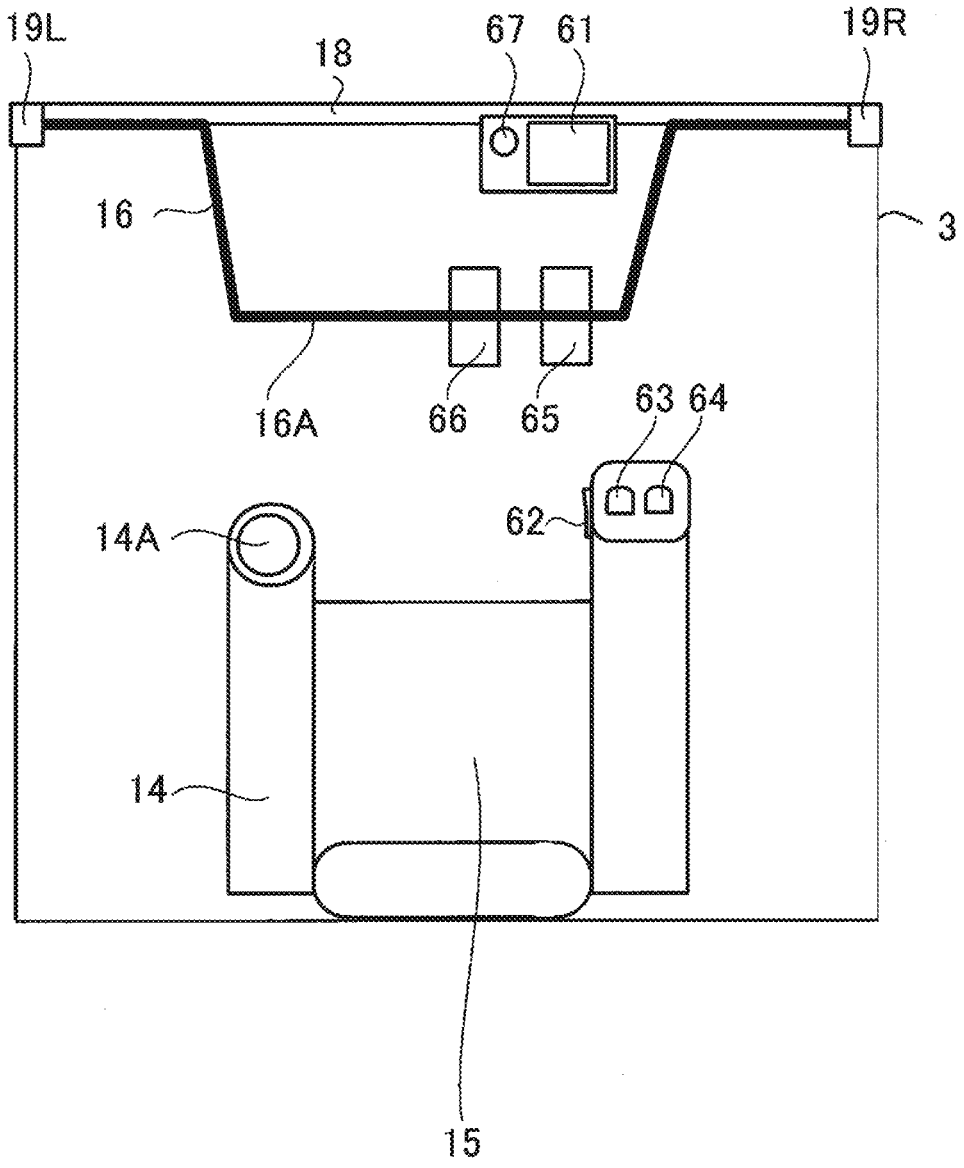
FIG. 2 is a diagram showing a configuration inside a driver's cab.

FIG. 2 is a schematic diagram showing a configuration inside the driver's cab 3 and is a diagram showing the inside of the driver's cab 3 as viewed from above.

The upper portion of FIG. 2 corresponds to the front of the forklift 1 (FIG. 1). In FIG. 2, a display unit 61 is provided at a frame member 18. The frame member 18 is located at an upper end of a front panel (not shown) which is provided from a floor of the driver's cab 3 to a predetermined height between left and right front pillars 19L and 19R. The display unit 61 is configured with, for example, a liquid crystal display panel, and visually displays information to the operator. As an operation member for operating or releasing a parking brake, a parking brake switch 67 is provided next to the display unit 61. The frame member 18 and the display unit 61 do not obstruct the front visibility of the operator.

As operation members for operating the cargo handling device 5, an operating lever 63 for lifting (hereinafter referred to as a lift lever 63) and an operating lever 64 for tilting (hereinafter referred to as a tilt lever 64) are provided in the vicinity of the driver's seat 15. The lift lever 63 is an operation member for moving the forks 9 up and down. The tilt lever 64 is an operation member for tilting the outer masts 6 (that is, the forks 9).

As an operation member for forward/reverse changeover, a forward/reverse changeover switch 62 is further provided in the vicinity of the driver's seat 15. The forward/reverse changeover switch 62 is an operation member for changing over a traveling direction of the forklift 1.

The safety bar 16 described above is disposed above the display unit 61 (in a direction away from the paper surface in FIG. 2). A portion 16A of the safety bar 16 protrudes toward the driver's seat 15 such that the operator can easily grasp the safety bar 16 and is disposed at a space position higher than the seat surface of the seat of the driver's seat 15. The space position of the portion 16A in the driver's cab 3 corresponds to a space position where a steering wheel is provided in a counterbalance type forklift of the conventional type (in which a steering wheel for steering is disposed in front of the driver's seat) which is not provided with the mini-steering 14A. In this way, when the forklift 1 according to this embodiment falls, the operator can grasp the portion 16A of the safety bar 16 with the same feeling as in a case where an operator grasps the steering wheel for steering and supports the body in the counterbalance type forklift of the conventional type.

An accelerator pedal 65 and a brake pedal 66 are provided on the floor surface of the driver's cab 3. The accelerator pedal 65 is an operation member for controlling the rotation of the traveling wheels 2. The rotation control of the traveling wheels 2 is performed by adjusting electric power which is supplied to a traveling motor M1 (described later). The operator adjusts the amount of depression of the accelerator pedal 65, whereby the traveling speed of the forklift 1 is controlled. The brake pedal 66 is an operation member for braking the rotation of the traveling wheels 2. The operator depresses the brake pedal 66, whereby the forklift 1 is braked.

In this embodiment, the forklift 1 is configured such that regenerative brake is applied in a case where the amount of depression of the accelerator pedal 65 by the operator decreases during traveling and/or a case where the amount of depression of the brake pedal 66 increases.

When the operation members described above are operated by the operator, input to each operation member is detected by the operation member, a sensor (described later), or the like, and the detected signal is input to a VCM 41 (described later).

Figure 3:
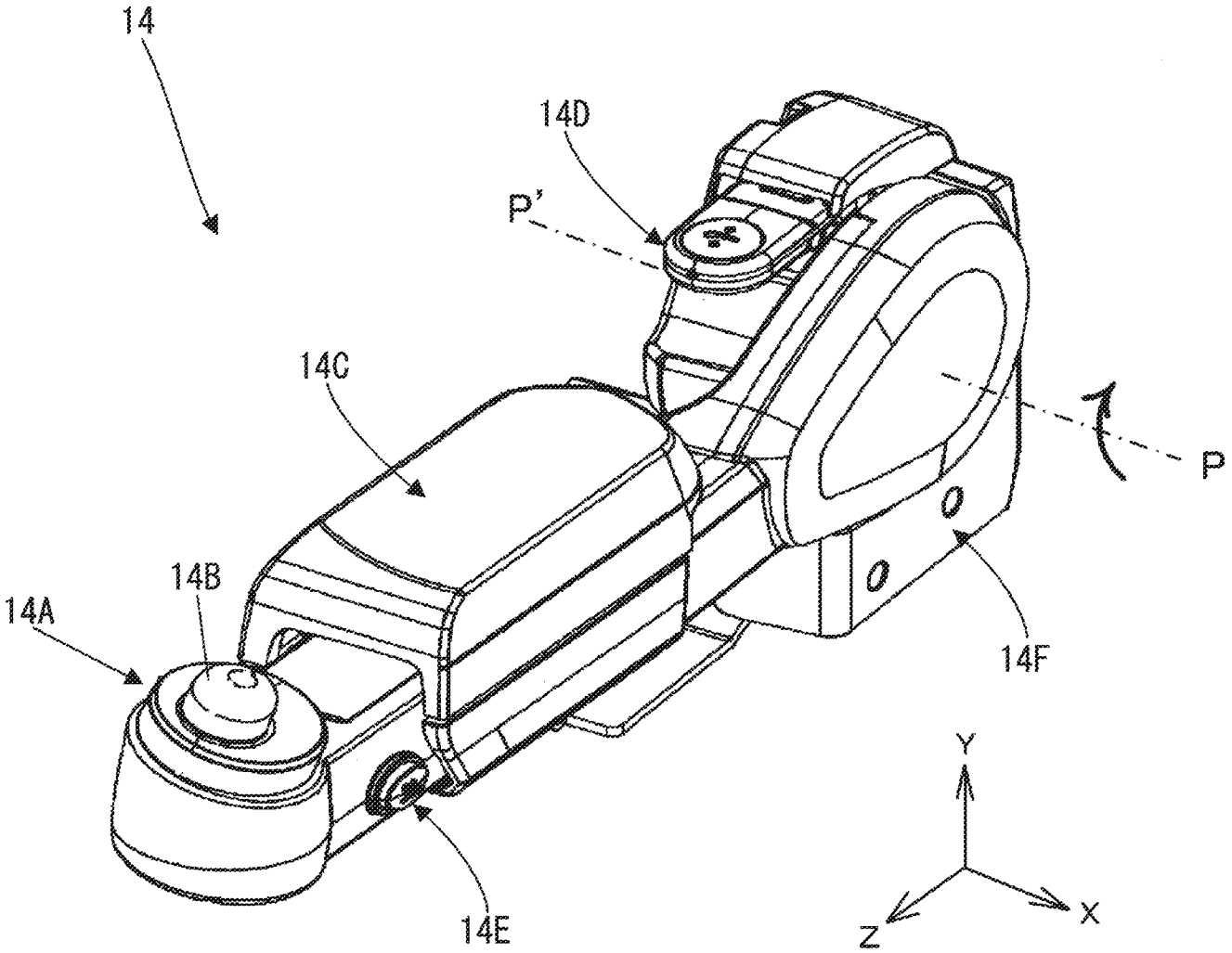
FIG. 3 is a perspective view showing details of an armrest that is at a use position.

FIG. 3 is a perspective view showing the details of the armrest 14 that is at the use position. In FIG. 3, XYZ axes configuring a right-hand coordinate system orthogonal to each other are defined, a Z-axis positive direction corresponds to the front of the forklift 1 (FIG. 1), an X-axis positive direction corresponds to the left side of the forklift 1, and a Y-axis positive direction corresponds to the upper side of the forklift 1. As described above, the armrest 14 is fixed to the seat of the driver's seat 15 shown in FIG. 1 by the base 14F configuring one end thereof. A straight line connecting the points P and P' shown in FIG. 3 and extending in an X-axis direction so as to penetrate the base 14F corresponds to a rotation axis of the armrest 14, and the armrest 14 is supported to be rotatable around the rotation axis P-P'. The structural strength of the support portion of the armrest 14 is calculated in consideration of the load by the operator. Therefore, even in a case where the forklift 1 according to this embodiment is likely to fall sideways, for example, it is possible to safely support the operator.

The mini-steering 14A described above is provided at the upper portion of the tip of the armrest 14. The mini-steering 14A has a disk shape having a smaller diameter than the steering wheel disposed in front of the driver's seat in the counterbalance type forklift of the conventional type. A rotatable circular knob 14B is provided on the upper portion of the disk-shaped mini-steering 14A. In this embodiment, the operator holds the knob 14B with the left hand and performs a rotating operation on the mini-steering 14A.

Since the position of the mini-steering 14A is closer to the operator's hand than the steering wheel disposed in front of the driver's seat in the counterbalance type forklift of the conventional type, the front visibility is improved and the operability for the operator is improved. Further, since the mini-steering 14A is configured to have a small diameter, the operability is further improved.

The mini-steering 14A has a built-in encoder (not shown). The encoder detects the rotation direction and rotation angle of the mini-steering 14A and transmits the detection signal to the VCM 41 (described later) through a wire in the armrest.

The detection signal may be transmitted from the mini-steering 14A to the VCM 41 by wireless transmission.

The armrest 14 is configured to be able to expand and contract in the front-rear direction (that is, a Z-axis direction). The operator pushes a position adjustment button 14E to release locking and expands and contracts the armrest 14 in the Z-axis direction. In this way, the length in the Z-axis direction from the rotation axis P-P' to the mini-steering 14A of the armrest 14 can be adjusted. The operator adjusts forward or backward the position in the Z-axis direction of the mini-steering 14A in accordance with the length of his/her arm.

Further, the armrest 14 is configured such that the height thereof can be adjusted in an up-down direction (that is, a Y-axis direction). The operator pulls a lever 14D provided on the base 14F in the Y-axis positive direction to release locking and expands and contracts the base 14F in the Y-axis direction. In this way, the height of the rotation axis P-P' of the armrest 14 can be adjusted. The operator adjusts the position in the Y-axis direction of the armrest 14 in accordance with his/her physique.

An arm pad 14C provided on the upper portion of the armrest 14 is configured to be slidable in the front-rear direction (that is, the Z-axis direction). Specifically, the movable arm pad 14C is provided so as to straddle the telescopic portion of the armrest 14. The arm pad 14C moves like a straddle-type monorail along a rail (not shown) provided at the telescopic portion of the armrest 14. In a case where the operator's left arm moves in the Z-axis direction when rotating the mini-steering 14A, the arm pad 14C moves in the Z-axis direction to follow the movement of the left arm, thereby facilitating the operator's operation on the mini-steering 14A.

The arm pad 14C is biased by a spring (not shown) such that it stays at the neutral position illustrated in FIG. 3 at the time of non-use.

The outline of each operation of traveling, cargo handling, and steering of the forklift 1 described above will be described.

Figure 4:
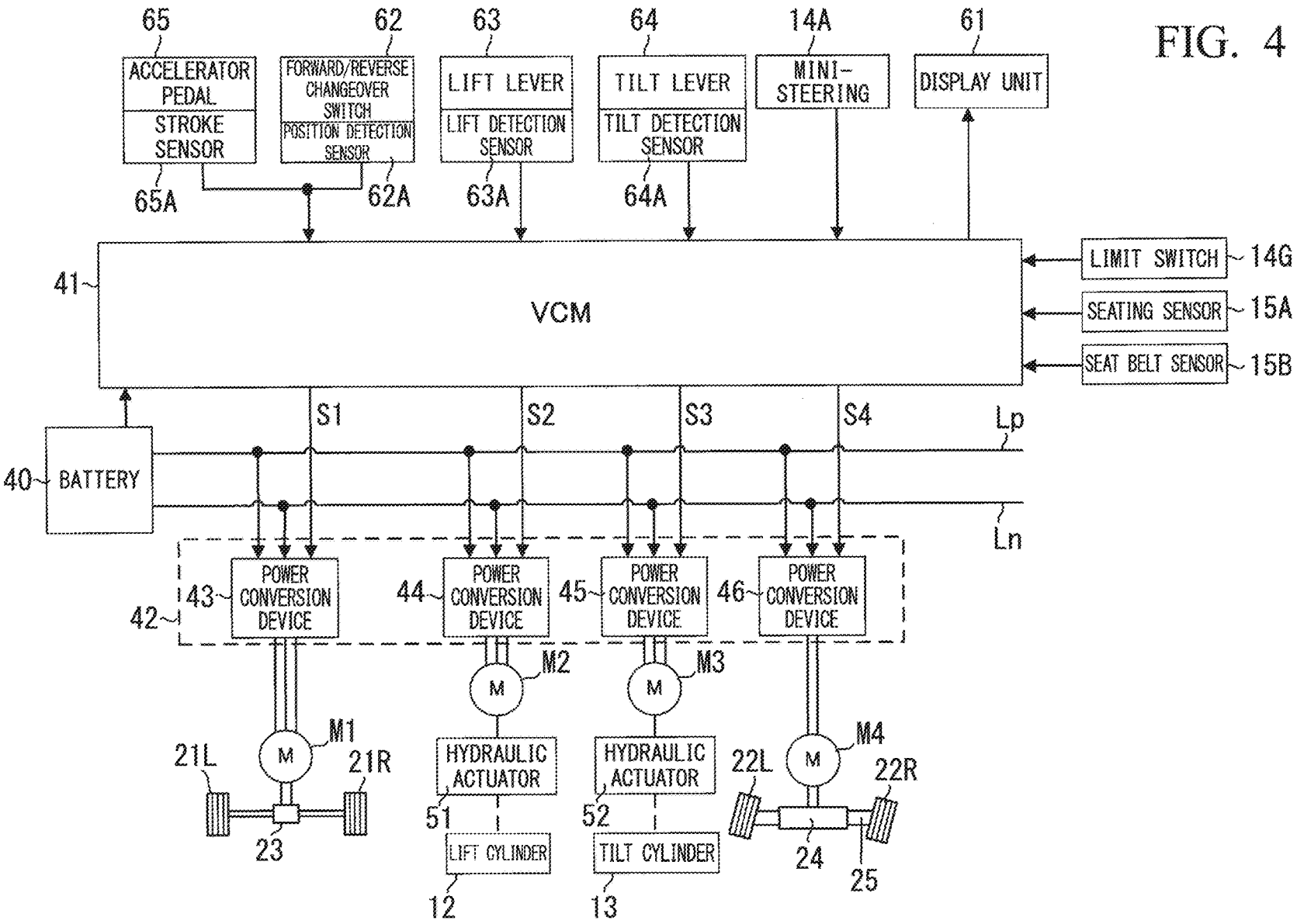
FIG. 4 is a block diagram showing a configuration of a main section of the forklift.

FIG. 4 is a block diagram showing a configuration of a main section of the forklift 1. Transmission of an electrical signal is indicated by a solid line, and transmission of a hydraulic pressure is indicated by a broken line. A battery 40 applies a predetermined voltage V between a P line Lp and an N line Ln. The VCM 41 includes a CPU, a ROM, and a RAM and controls all the operations of the forklift 1 by expanding and executing a program stored in the ROM in the RAM.

Figure 5A:
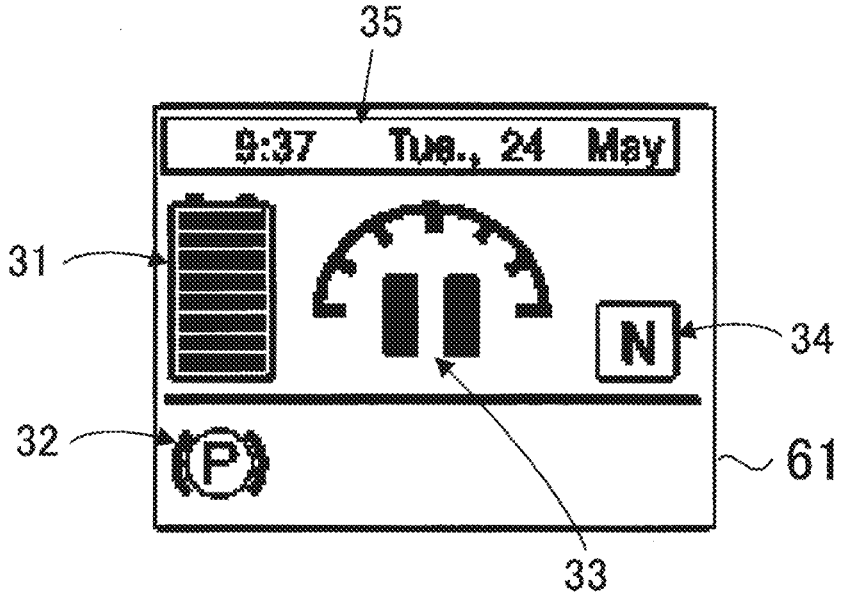
FIG. 5A is a diagram showing a display screen of a display unit.

FIG. 5A is a diagram showing a display screen of the display unit 61. The VCM 41 causes the display unit 61 to visually display information on the forklift 1 to the operator. In FIG. 5A, battery information 31 indicates the state of charge of the battery 40. The VCM 41 causes the display unit 61 to display the battery information 31, based on the signal from the battery 40. Parking brake information 32 indicates that the parking brake is in operation. When the operator operates the parking brake switch 67, so that the parking brake is operated, the VCM 41 causes the display unit 61 to display the parking brake information 32. The VCM 41 turns off the parking brake information 32 in a case where the parking brake is released.

Steering angle information 33 indicates the steering angle of steering wheels. The VCM 41 causes the display unit 61 to display the steering angle information 33, based on the steering angle detected by, for example, an angle sensor (not shown). Forward/reverse information 34 indicates the position (forward F, neutral N, or reverse R) of the forward/reverse changeover switch 62. The VCM 41 causes the display unit 61 to display the forward/reverse information 34, based on the detection signal by a position detection sensor 62A that detects the position of the forward/reverse changeover switch 62.

Further, the VCM 41 causes the display unit 61 to display other information 35, based on a setting operating by the operator. In the example of FIG. 5A, date and time information is displayed as the other information 35.

Returning to FIG. 4, the detection signals from the position detection sensor 62A that detects the position of the forward/reverse changeover switch 62, an accelerator stroke sensor 65A that detects the amount of depression of the accelerator pedal 65 (hereinafter referred to as an accelerator operating amount), a lift detection sensor 63A that detects the operating amount of the lift lever 63, a tilt detection sensor 64A that detects the operating amount of the tilt lever 64, and the mini-steering 14A are input to the VCM 41 as electrical signals. The VCM 41 generates a first control signal S1 to a fourth control signal S4, based on each input signal. The first control signal S1 to the fourth control signal S4 are also electrical signals.

A power conversion device 42 drives the traveling motor M1, a lift motor M2, a tilt motor M3, and a steering motor M4, based on the first control signals S1 to the fourth control signals S4 generated by the VCM 41. The power conversion device 42 includes a first power conversion device 43 to a fourth power conversion device 46.

The first power conversion device 43 converts the direct-current voltage V into a three-phase alternating-current signal, based on the first control signal S1, and supplies it to the traveling motor M1. Further, the second power conversion device 44 converts the direct-current voltage V into a three-phase alternating-current signal, based on the second control signal S2, and supplies it to the lift motor M2 as a cargo handling motor. The third power conversion device 45 converts the direct-current voltage V into a three-phase alternating-current signal, based on the third control signal S3, and supplies it to the tilt motor M3 as a cargo handling motor. Further, the fourth power conversion device 46 drives the steering motor M4, which is a direct-current motor, by, for example, chopper control, based on the fourth control signal S4.

<Traveling>

In this embodiment, the operating on the forward/reverse changeover switch 62 and the accelerator pedal 65 is referred to as a traveling operation. The VCM 41 outputs the first control signal S1 to the first power conversion device 43, based or the detection signal from the position detection sensor 62A that detects the position of the forward/reverse changeover switch 62 and the detection signal from the accelerator stroke sensor 65A that detects the accelerator operating amount.

The VCM 41 outputs the first control signal S1 to the first power conversion device 43 in a state where interlock which will be described in detail later is released, and does not output the first control signal S1 in an interlock state.

The first power conversion device 43 controls the electric power which is supplied to the traveling motor M1 in response to the first control signal S1. The traveling motor M1 drives a left front wheel 21L and a right front wheel 21R, which are drive wheels, through a differential device 23.

In this embodiment, the first power conversion device 43, the traveling motor M1, the differential device 23, and the drive wheels configure a traveling device.

<Cargo Handling>

In this embodiment, the operating on the lift lever 63 and the tilt lever 64 is referred to as a cargo handling operation. The VCM 41 outputs the second control signal S2 to the second power conversion device 44, based on the detection signal from the lift detection sensor 63A that detects the operating amount of the lift lever 63.

The VCM 41 outputs the second control signal S2 to the second power conversion device 44 in a state where the interlock which will be described in detail later is released, and does not output the second control signal S2 in the interlock state.

The second power conversion device 44 controls the electric power which is supplied to the lift motor M2 in response to the second control signal S2. In this way, the rotation of the lift motor M2 is controlled. A hydraulic actuator 51 converts the rotary motion generated by the lift motor M2 into a linear motion. The lift cylinder 12 connected to the hydraulic actuator 51 moves the inner masts 7 up and down.

Further, the VCM 41 outputs the third control signal S3 to the third power conversion device 45, based on the detection signal from the tilt detection sensor 64A that detects the operating amount of the tilt lever 64.

The VCM 41 outputs the third control signal S3 to the third power conversion device 45 in a state where the interlock which will be described in detail later is released, and does not output the third control signal S3 in the interlock state, similar to the case of the lift lever 63.

The third power conversion device 45 controls the electric power which is supplied to the tilt motor M3 in response to the third control signal S3. In this way, the rotation of the tilt motor M3 is controlled. A hydraulic actuator 52 converts the rotary motion generated by the tilt motor M3 into a linear motion. The tilt cylinder 13 connected to the hydraulic actuator 52 tilts the outer masts 6 in the front-rear direction.

In this embodiment, the second power conversion device 44, the lift motor M2, the hydraulic actuator 51, the lift cylinder 12, the third power conversion device 45, the tilt motor M3, the hydraulic actuator 52, and the tilt cylinder 13 are included in the cargo handling device 5.

<Steering>

In this embodiment, the operating on the mini-steering 14A is referred to as a steering operation. The detection signal which is input from the mini-steering 14A to the VCM 41 indicates the rotation direction and rotation angle of the mini-steering 14A, as described above. The VCM 41 outputs the fourth control signal S4 corresponding to the rotation angle to the fourth power conversion device 46.

The VCM 41 outputs the fourth control signal S4 to the fourth power conversion device 46 in a state where the interlock which will be described in detail later is released, and does not output the fourth control signal S4 in the interlock state.

The fourth power conversion device 46 supplies electric power corresponding to the fourth control signal to the steering motor M4 and controls the rotation speed thereof. Left and right rear wheels 22L and 22R, which are the steering wheels, are connected to a gearbox 24 through, for example, an Ackermann link mechanism 25. The rotary motion of the steering motor M4 is transmitted to the Ackermann link mechanism 25 through the gearbox 24, whereby the left and right rear wheels 22L and 22R are steered.

In this embodiment, the fourth power conversion device 46, the steering motor M4, the gearbox 24, the Ackermann link mechanism 25, and the steering wheels configure the steering device.

<Interlock>

Subsequently, the interlock control of the forklift 1 will be described. The VCM 41 of this embodiment performs the interlock control to prohibit the traveling operation, the cargo handling operation, and the steering operation in a case where conditions determined in advance are not satisfied.

The VCM 41 locks the interlock in a case where at least one of three conditions: (Condition 1) the armrest 14 is located at the use position, (Condition 2) the operator is seated in the driver's seat 15, and (Condition 3) a seat belt (not shown) provided at the driver's seat 15 is locked, is not satisfied, to prohibit all of the traveling operation, the cargo handling operation, and the steering operation described above. In other words, the VCM 41 permits the traveling operation, the cargo handling operation, and the steering operation in a case where all the three conditions: (Condition 1), (Condition 2), and (Condition 3), are satisfied.

In FIG. 4, a limit switch 14G is built in, for example, the base 14F (FIG. 3) of the armrest 14, and outputs different signals according to whether or not the armrest 14 is at the use position. The VCM 41 determines whether or not the armrest 14 is at the use position, by the signal from the limit switch 14G.

Further, a seating sensor 15A is configured with, for example, a pressure sensor built in the seat of the driver's seat 15, and outputs different signals according to the presence or absence of the pressure due to the seating of the operator. The VCM 41 determines whether or not the operator is seated in the driver's seat 15, by the signal from the seating sensor 15A.

Furthermore, a seat belt sensor 15B is configured with, for example, a sensor built in a catcher for a seat belt (not shown) provided at the driver's seat 15 and outputs different signals according to the presence or absence of the fastening of the seat belt. The VCM 41 determines whether or not the seat belt has been fastened, by the signal from the seat belt sensor 15B.

The VCM 41 prohibits the above-described traveling operation in a case where the traveling operation is performed by the operator in a state where at least one of the three conditions: (Condition 1), (Condition 2), and (Condition 3) described above, is not satisfied.

Example 1

For example, in a case where the armrest 14 is at the use position and the operator is seated in the driver's seat 15 operates the forward/reverse changeover switch 62 to the position of the forward F without fastening the seat belt, (Condition 3) is not satisfied, so that the VCM 41 locks the interlock.

Figure 5B:
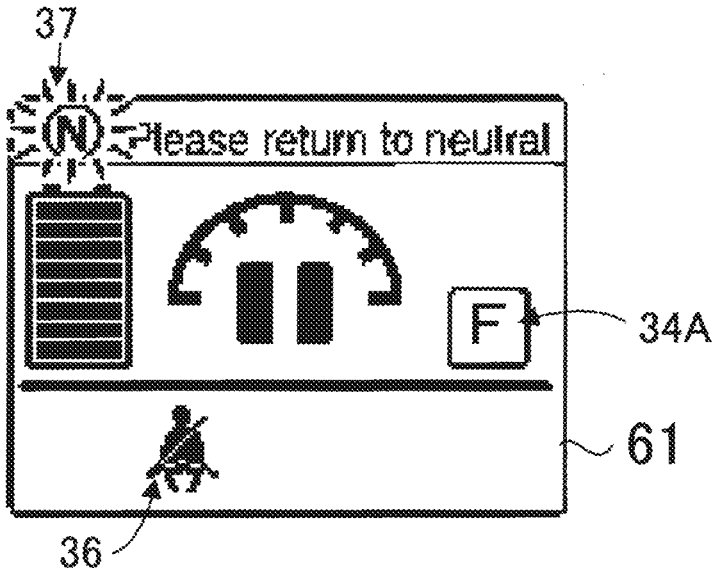
FIG. 5B is a diagram showing the display screen in a traveling interlock state.

FIG. 5B is a diagram showing the display screen of the display unit 61 in a traveling interlock state. The VCM 41 causes the display unit 61 to display a warning display 37 in order to notify the operator that the interlock state is in effect. The warning display 37 is an example including a message promoting to operate the forward/reverse changeover switch 62 to the position of the neutral N.

When all the three conditions: (Condition 1), (Condition 2), and (Condition 3), are satisfied by the operator, the forward/reverse changeover switch 62 is operated to the position of the neutral N, and the depression of the accelerator pedal 65 is not detected, the VCM 41 unlocks the interlock and turns off the warning display 37 on the display unit 61.

In FIG. 5B, seat belt information 36 indicates that the seat belt is not fastened. The VCM 41 causes the display unit 61 to display the seat belt information 36 in a case where the seat belt is not fastened. Further, the VCM 41 turns off the seat belt information 36 in a case where the seat belt is fastened.

Further, in FIG. 5B, forward/reverse information 34A indicates that the position of the forward/reverse changeover switch 62 is at, the forward F.

Example 2

For example, in a case where the operator is seated in the driver's seat 15 fastens the seat belt and operates the forward/reverse changeover switch 62 to the position of the forward F in a state where the armrest 14 is flipped up (that is, the armrest 14 is not at the use position), (Condition 1) is not satisfied, so that the VCM 41 locks the interlock.

The VCM 41 causes the display unit 61 to display a warning display in order to notify the operator that the interlock state is in effect. The warning display in this case is to turn off the seat belt information 36 from the display screen of FIG. 5B.

When all the three conditions: (Condition 1), (Condition 2), and (Condition 3), are satisfied by the operator, the forward reverse changeover switch 62 is operated to the position of the neutral N, and the depression of the accelerator pedal 65 is not detected, the VCM 41 unlocks the interlock and turns off the warning display on the display unit 61.

In a case where the cargo handling operation is performed by the operator in a state where at least one of the three conditions: (Condition 1), (Condition 2), and (Condition 3), is not satisfied, the VCM 41 prohibits the cargo handling operation described above.

Example 3

For example, in a case where the armrest 14 is at the use position and the operator operates the lift lever 63 or the tilt lever 64 without fastening the seat belt and without sitting on the driver's seat 15, (Condition 2) and (Condition 3) are not satisfied, so that the VCM 41 locks the interlock.

Figure 5C:
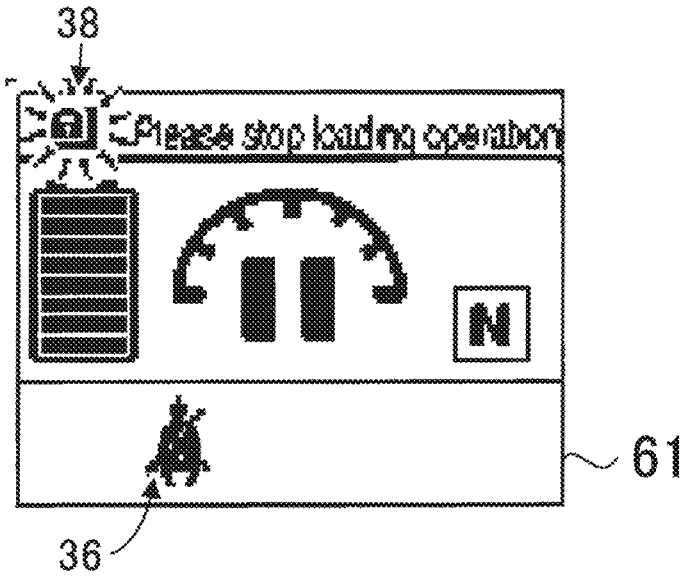
FIG. 5C is a diagram showing the display screen in a cargo handling interlock state.

FIG. 5C is a diagram showing the display screen of the display unit 61 in a cargo handling interlock state. The VCM 41 causes the display unit 61 to display a warning display 38 in order to notify the operator that the interlock state is in effect. The warning display 38 is an example including a message promoting to stop the cargo handling operation. When all the three conditions: (Condition 1), (Condition 2), and (Condition 3), are satisfied by the operator and the lift lever 63 and the tilt lever 64 are operated to the neutral positions, the VCM 41 unlocks the interlock and turns off the warning display 38 on the display unit 61.

In a case where the steering operation is performed by the operator in a state where at least one of (Condition 1), (Condition 2), and (Condition 3) is not satisfied, the VCM 41 prohibits the steering operation described above.

Example 4

For example, in a case where the armrest 14 is at the use position and the operator is seated in the driver's seat 15 operates the mini-steering 14A without fastening the seat belt, (Condition 3) is not satisfied, so that the VCM 41 locks the interlock.

When all the three conditions: (Condition 1), (Condition 2), and (Condition 3), are satisfied by the operator and the operating of the mini-steering 14A is not detected, the VCM 41 unlocks the interlock.

In this embodiment, warning display for notifying the operator that the steering interlock state is in effect is not performed. However, the warning display may be displayed on the display unit 61.

<Flowchart Description>

——Flag Set Processing——

Figure 6:
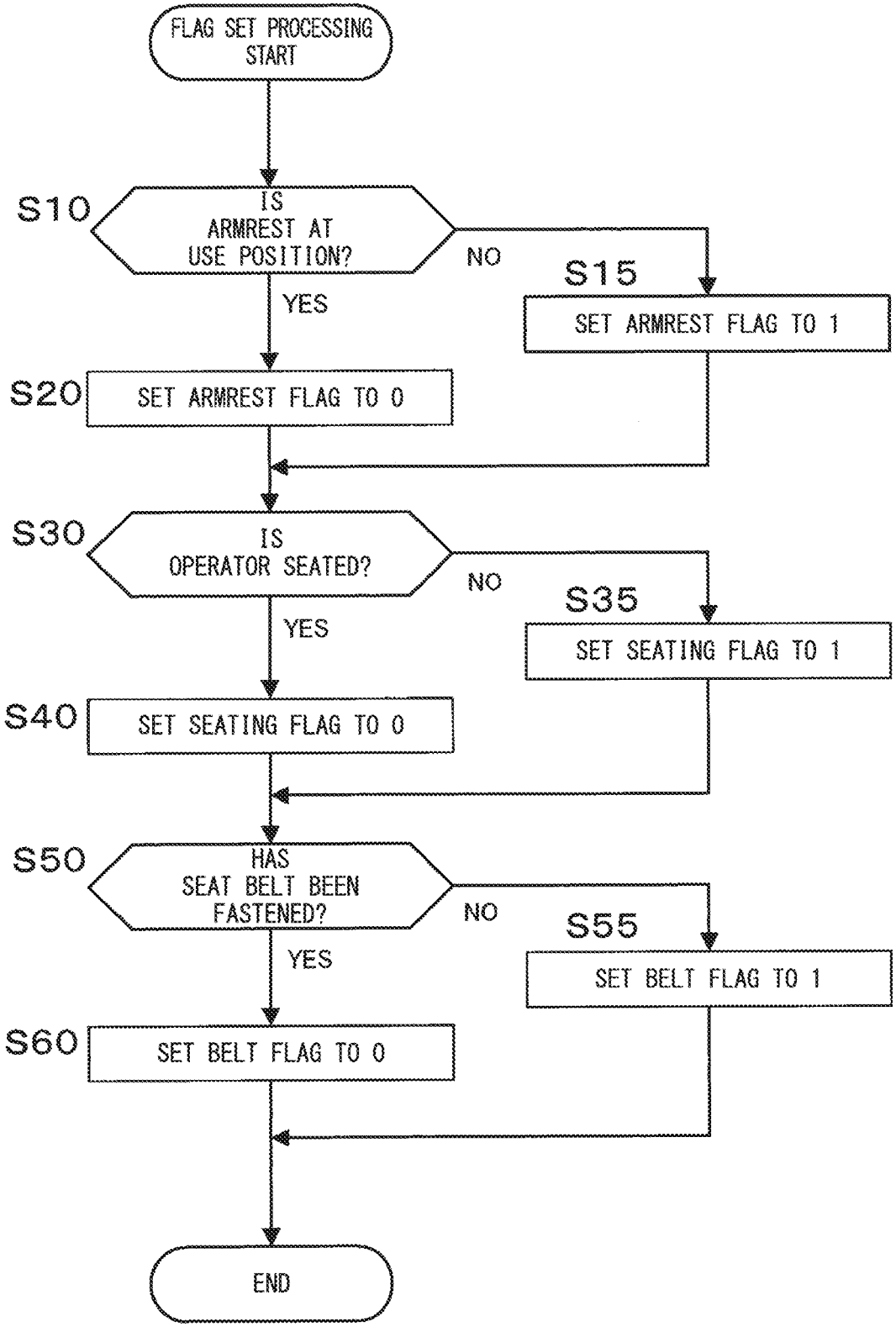
FIG. 6 is a flowchart showing a flow of processing of setting a flag that is used for interlock control.

FIG. 6 is a flowchart showing a flow of processing of setting a flag that is used for the interlock control. The VCM 41 executes the processing according to FIG. 6 at predetermined time intervals. In step S10, the VCM 41 determines whether or not the armrest 14 is at the use position. In a case where the armrest 14 is at the use position, the VCM 41 determines that step S10 is affirmative, and proceeds to step S20, and in step S20, an armrest flag is set to 0 and the VCM 41 proceeds to step S30. In a case where the armrest 14 is not at the use position, the VCM 41 determines that step S10 is negative, and proceeds to step S15, and in step S15, the armrest flag is set to 1 and the VCM 41 proceeds to step S30.

In step S30, the VCM 41 determines whether or not the operator is seated in the driver's seat 15. In a case where, the operator has sat, the VCM 41 determines that step S30 is affirmative, and proceeds to step S40, and in step S40, a seating flag is set to 0 and the VCM 41 proceeds to step S50, In a case where the operator is not seated, the VCM 41 determines that step S30 is negative, and proceeds to step S35, and in step S35, the seating flag is set to 1 and the VCM 41 proceeds to step S50.

In step S50, the VCM 41 determines whether or not the seat belt has been fastened. In a case where the seat belt has been fastened, the VCM 41 determines that step S50 is affirmative, and proceeds to step S60, and in step S60, a belt flag is set to 0 and the processing according to FIG. 6 ends. In a case where the seat belt has not been fastened, the VCM 41 determines that step S50 is negative, and proceeds to step S55, and in step S55, the belt flag is set to 1 and the processing according to FIG. 6 ends.

——Interlock Locking——

Figure 7:
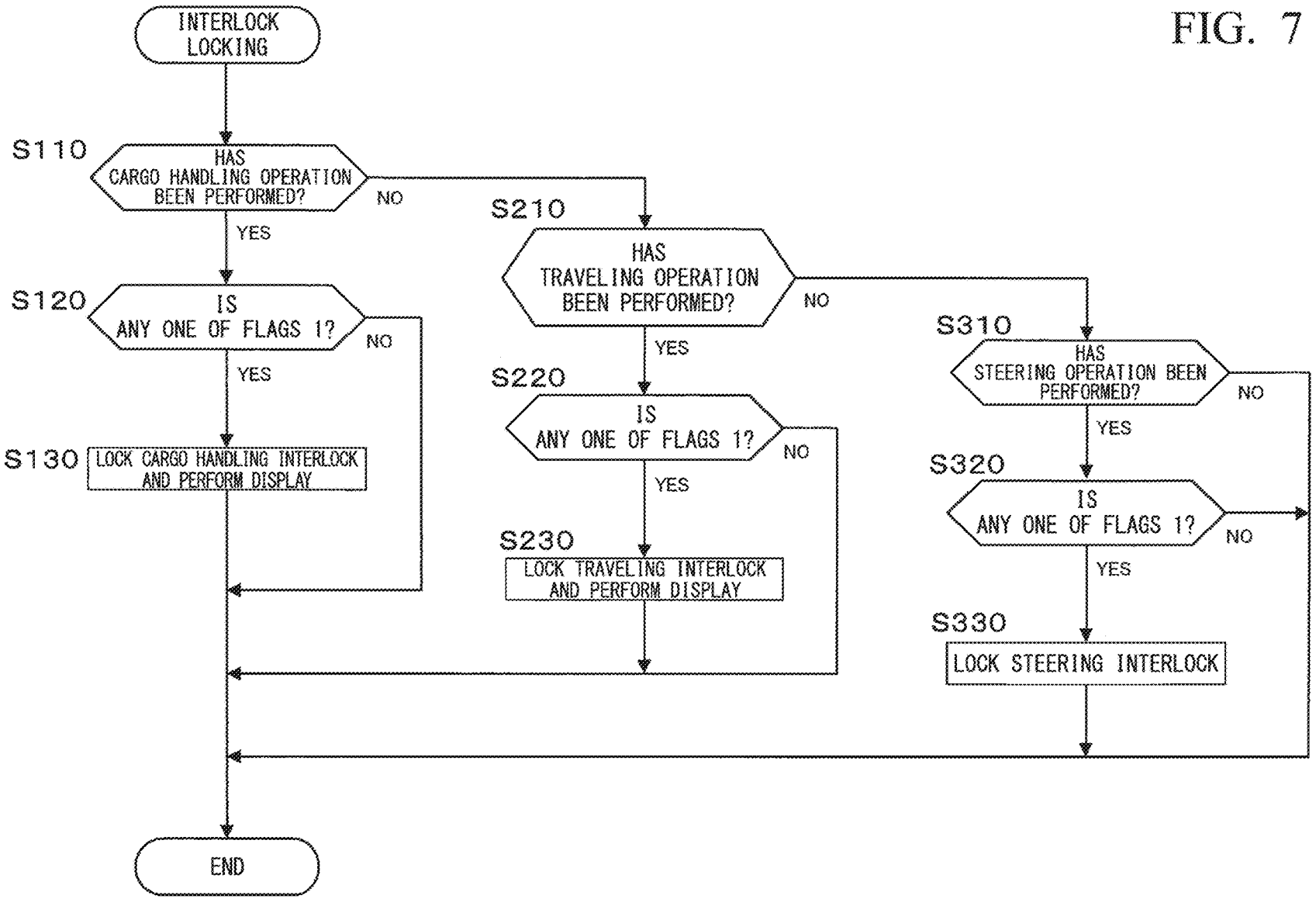
FIG. 7 is a flowchart showing a flow of interlock locking control processing.

FIG. 7 is a flowchart showing a flow of interlock locking control processing. The VCM 41 starts the processing according to FIG. 7, every time the traveling operation, the cargo handling operation, or the steering operation is performed in a state where the interlock is released, that is, every time the detection signal is input from the accelerator stroke sensor 65A, the position detection sensor 62A, the lift detection sensor 63A, the tilt detection sensor 64A, or the mini-steering 14A. In step S110, the VCM 41 determines whether or not the cargo handling operation has been performed. In a case where the lift lever 63 or the tilt lever 64 has been operated, the VCM 41 determines that step S110 is affirmative, and proceeds to step S120. In a case where neither the lift lever 63 nor the tilt lever 64 has been operated, the VCM 41 determines that step S110 is negative, and proceeds to step S210.

In step S120, the VCM 41 determines whether or not any one of the armrest flag, the seating flag, and the belt flag has been set to 1 by the flag set processing of FIG. 6. In a case where at least one of the flags is 1, the VCM 41 determines that step S120 is affirmative, and proceeds to step S130, and in step S130, the cargo handling interlock is locked, a warning display is displayed on the display unit 61, and the processing according to FIG. 7 ends. The VCM 41 does not output the first control signal S1 to the fourth control signal S4 to the power conversion device 42 until the interlock is unlocked. In this way, the interlock state is created, and in the forklift 1, not only the cargo handling operation but also the traveling operation and the steering operation are prohibited.

On the other hand, in a case where all the flags are 0, the VCM 41 determines that step S120 is negative, and ends the processing according to FIG. 7 without applying the interlock.

In step S210, the VCM 41 determines whether or not the traveling operation has been performed. For example, in a case where the position of the forward/reverse changeover switch 62 is the forward F or the reverse R and the accelerator pedal 65 has been operated, the VCM 41 determines that step S210 is affirmative, and proceeds to step S220. In a case where the position of the forward/reverse changeover switch 62 is the neutral N or the accelerator pedal 65 has not been operated, the VCM 41 determines that step S210 is negative, and proceeds to step S310.

In step S220, the VCM 41 determines whether or not any one of the armrest flag, the seating flag, and the belt flag has been set to 1 by the flag set processing of FIG. 6. In a case where at least one of the flags is 1, the VCM 41 determines that step S220 is affirmative, and proceeds to step S230, and in step S230, the traveling interlock is locked, a warning display is displayed on the display unit 61, and the processing according to FIG. 7 ends. The VCM 41 does not output the first control signal S1 to the fourth control signal S4 to the power conversion device 42 until the interlock is unlocked. In this way, the interlock state is created, and in the forklift 1, not only the traveling operation but also the cargo handling operation and the steering operation are prohibited.

On the other hand, in a case where all the flags are 0, the VCM 41 determines that step S220 is negative, and ends the processing according to FIG. 7 without applying the interlock.

In step S310, the VCM 41 determines whether or not the steering operation has been performed. In a case where the mini-steering 14A has been operated, the VCM 41 determines that step S210 is affirmative, and proceeds to step S220. In a case where the mini-steering 14A has not been operated, the VCM 41 determines that step S310 is negative, and ends the processing according to FIG. 7 without applying the interlock.

In step S320, the VCM 41 determines whether or not any one of the armrest flag, the seating flag, and the belt flag has been set to 1 by the flag set processing of FIG. 6. In a case where at least one of the flags is 1, the VCM 41 determines that step S320 is affirmative, and proceeds to step S330, and in step S330, the steering interlock is locked, and the processing according to FIG. 7 ends. The VCM 41 does not output the first control signal S1 to the fourth control signal S4 to the power conversion device 42 until the interlock is unlocked. In this way, the interlock state is created, and in the forklift 1, not only the steering operation but also the cargo handling operation and the traveling operation are prohibited.

On the other hand, in a case where all the flags are 0, the VCM 41 determines that step S320 is negative, and ends the processing according to FIG. 7 without applying the interlock.

——Interlock Unlocking——

Figure 8:
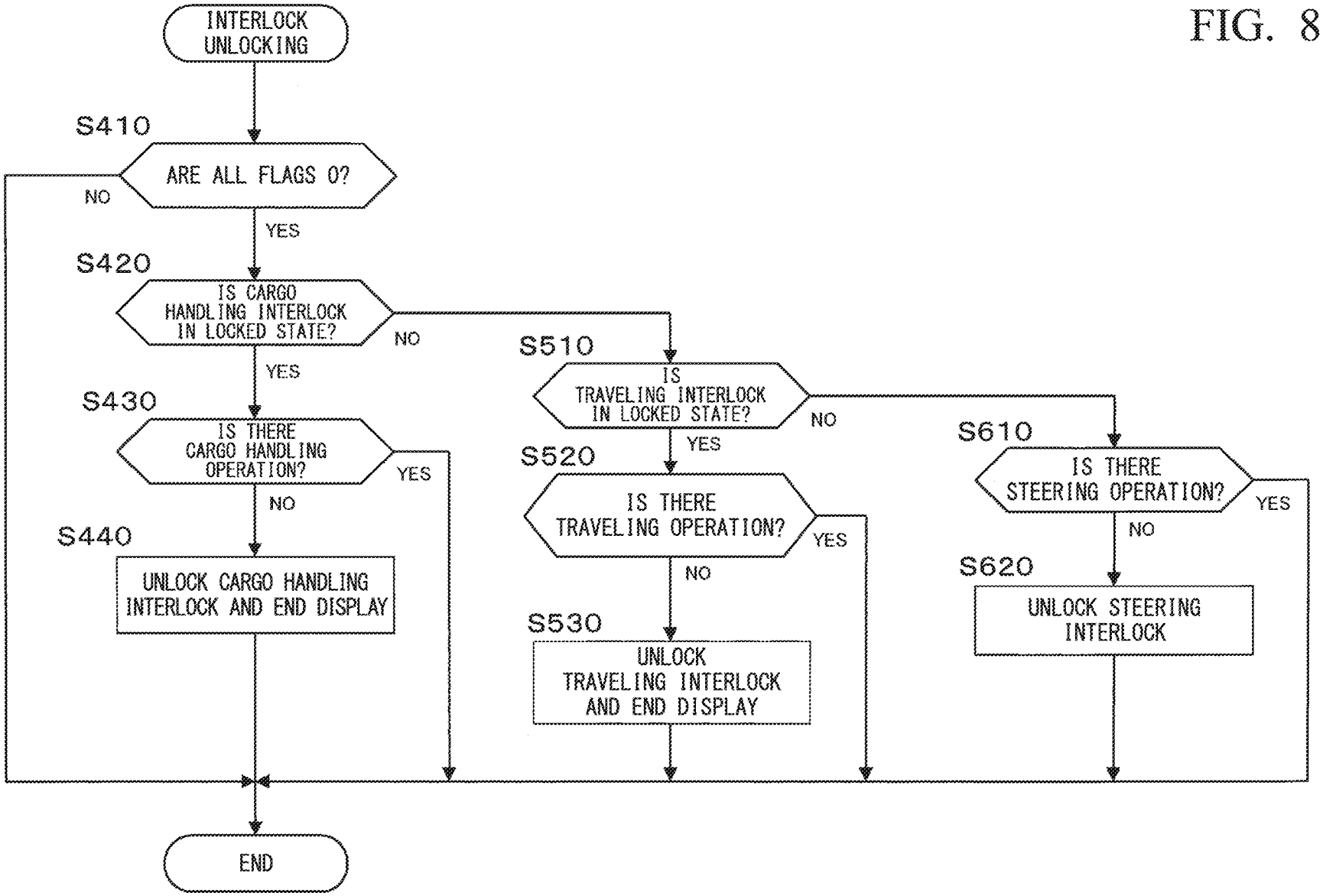
FIG. 8 is a flowchart showing a flow of interlock unlocking control processing.

FIG. 8 is a flowchart showing a flow of interlock unlocking control processing. The VCM 41 starts the processing according to FIG. 8, every time the traveling operation, the cargo handling operation, or the steering operation is performed in a state where the interlock is locked, that is, every time the detection signal is input from the accelerator stroke sensor 65A, the position detection sensor 62A, the lift detection sensor 63A, the tilt detection sensor 64A, or the mini-steering 14A. In step S410, the VCM 41 determines whether or not all of the armrest flag, the seating flag, and the belt flag have been set to 0 by the flag set processing of FIG. 6. In a case where all the flags are 0, the VCM 41 determines that step S410 is affirmative, and proceeds to step S420. In a case where at least one of the flags is 1, the VCM 41 determines that step S410 is negative, and ends the processing according to FIG. 8 without unlocking the interlock.

In step S420, the VCM 41 determines whether or not the cargo handling interlock has been locked. In a case of being in a state where the cargo handling interlock is applied, the VCM 41 determines that step S420 is affirmative, and proceeds to step S430, and in a case of being in a state where the interlock other than the cargo handling interlock is applied, the VCM 41 determines that step S420 is negative, and proceeds to step S510.

In step S430, the VCM 41 determines whether or not there is the cargo handling operation. In a case where the lift lever 63 and the tilt lever 64 have been returned, the VCM 41 determines that step S430 is negative, and proceeds to step S440. In a case where the lift lever 63 or the tilt lever 64 have been operated, the VCM 41 determines that step S430 is affirmative, and ends the processing according to FIG. 8 without unlocking the interlock.

In step S440, the VCM 41 unlocks the cargo handling interlock, ends the warning display on the display unit 61, and ends the processing according to FIG. 8. The VCM 41 outputs the first control signal S1 to the fourth control signal S4 to the power conversion device 42. In this way, in the forklift 1, not only the cargo handling operation but also the traveling operation and the steering operation are permitted.

In step S510, the VCM 41 determines whether or not the traveling interlock has been locked. In a case of being in a state where the traveling interlock is applied, the VCM 41 determines that step S510 is affirmative, and proceeds to step S520, and in a case of being in a state where the interlock other than the traveling interlock is applied, the VCM 41 determines that step S510 is negative, and proceeds to step S610.

In step S520, the VCM 41 determines whether or not there is the traveling operation. For example, in a case where the position of the forward/reverse changeover switch 62 is changed over to at the neutral N and the accelerator pedal 65 has been returned, the VCM 41 determines that step S520 is negative, and proceeds to step S530. In a case where the position of the forward/reverse changeover switch 62 is not at the neutral N or die accelerator pedal 65 has been operated, the VCM 41 determines that step S520 is affirmative, and ends the processing according to FIG. 8 without unlocking the interlock.

In step S520, the VCM 41 unlocks the traveling interlock, ends the warning display on the display unit 61 and ends the processing according to FIG. 8. The VCM 41 outputs the first control signal S1 to the fourth control signal S4 to the power conversion device 42. In this way, in the forklift 1, not only the traveling operation but also the cargo handling operation and the steering operation are permitted.

A case of proceeding to step S610 is a case where the steering interlock has been locked. In step S610, the VCM 41 determines whether or not there is the steering operation. In a case where the mini-steering 14A has not been operated, the VCM 41 determines that step S610 is negative, and proceeds to step S620. In a case where the mini-steering 14A has been operated, the VCM 41 determines that step S610 is affirmative, and ends the processing according to FIG. 8 without unlocking the interlock.

In step S620, the VCM 41 unlocks the steering interlock and ends the processing according to FIG. 8. The VCM 41 outputs the first control signal S1 to the fourth control signal S4 to the power conversion device 42. In this way, in the forklift 1, not only the steering operation but also the cargo handling operation and the traveling operation are permitted.

According to the embodiment described above, the following operation and effects are obtained.

(1) The forklift 1 described above adopts a steer-by-wire (steering-by-wire) type steering device (the fourth power conversion device 46, the steering motor M4, the gearbox 24, the Ackermann link mechanism 25, the rear wheels 22L and 22R) and performs the steering operation by the mini-steering 14A provided on the movable armrest 14. That is, the forklift 1 includes: the armrest 14 that is provided at the driver's seat 15 and is moved between the non-operation position and the operation position by a movable mechanism supported rotatably; the mini-steering 14A that is provided on the armrest 14 and outputs an operation signal in response to the steering operation; the steering device that changes the steering angle of the steering wheels of the forklift 1; the VCM 41 that electrically transmits the operation signal from the mini-steering 14A to the steering device to change the steering angle according to the operation signal; and the limit switch 14G that detects whether the armrest 14 is at the non-operation position or at the operation position. When the limit switch 14G detects that the armrest 14 is at the non-operation position, the VCM 41 controls the steering device such that the steering device does not change the steering angle even if the mini-steering 14A is operated. According to the forklift 1, the front visibility of the operator can be improved as compared with the case of the counterbalance type Forklift of the conventional type having a steering wheel in front of the driver's seat.

Further, according to the forklift 1, for example, in a case where the operator operates the mini-steering 14A While the armrest 14 of the forklift 1 is flipped up and is at the non-operation position, the steering angle cannot be changed, and therefore, the safety can be improved.

Further, the position of the mini-steering 14A provided on the armrest 14 of the forklift 1 is closer to the operator's hand as compared with the steering wheel disposed in front of the driver's seat in the counterbalance type forklift of the conventional type, and therefore, the operability by the operator can be improved.

(2) The limit switch 14G detects a first position where the armrest 14 supports the arm of the operator as the operation position, and detects a second position different from the first position as the non-operation position, and therefore, whether the armrest 14 is at the operation position or at the non-operation position can be appropriately detected.

(3) When the limit switch 14G detects that the armrest 14 is at the non-operation position, the VCM 41 of the forklift 1 does not output the fourth control signal S4 to the steering device, that is, does not transmit the operation signal from the mini-steering 14A to the steering device, such that the steering device does not change the steering angle. In this way, it is possible to appropriately prohibit the steering.

(4) The forklift 1 further includes the seating sensor 15A that detects whether or not the operator is seated in the driver's seat 15, and when the seating sensor 15A detects that the operator is not seated, the VCM 41 does not transmit the operation signal from the mini-steering 14A to the steering device such that the steering device does not change the steering angle, even if the limit switch 14G detects that the armrest 14 is at the operation position and the mini-steering 14A is operated. In this way, for example, in a case where the operator operates the mini-steering 14A from outside the forklift 1, it is not possible to change the steering angle, and therefore, safety can be improved.

(5) The forklift 1 further includes: the lift detection sensor 63A and the tilt detection sensor 64A that output cargo handling operation information in response to the cargo handling operation; and the cargo handling device 5 that drives the forks 9, based on the cargo handling operation information. The VCM 41 electrically transmits the cargo handling operation information from the lift detection sensor 63A and the tilt detection sensor 64A to the cargo handling device 5 to drive the forks 9 according to the cargo handling operation information, and when the limit switch 14G detects that the armrest 14 is at the non-operation position, the VCM 41 controls the cargo handling device 5 such that the cargo handling device 5 does not drive the forks 9 even if the cargo handling operation is performed.

In this way, for example, in a case where the operator performs the cargo handling operation while the armrest 14 of the forklift 1 is flipped up and is at the non-operation position, the forks 9 cannot be driven, and therefore, safety can be improved.

(6) The lift detection sensor 63A and the tilt detection sensor 64A of the forklift 1 output the cargo handling operation information in response to the lifting operating or the tilting operating, and therefore, it is possible to appropriately detect the cargo handling operation.

(7) The VCM 41 of the forklift 1 does not transmit the cargo handling operation information to the cargo handling device 5 such that the cargo handling device 5 does not drive the forks 9 even if the cargo handling operation is performed, and therefore, it is possible to appropriately prohibit the cargo handling operation.

(8) The forklift 1 further includes: the accelerator stroke sensor 65A and the position detection sensor 62A that output the traveling operation information in response to the traveling operation; and the traveling device (the first power conversion device 43, the traveling motor M1, the differential device 23, and the drive wheels) that drives the drive wheels of the forklift 1, based on the traveling operation information, and the VCM 41 electrically transmits the traveling operation information from the accelerator stroke sensor 65A and the position detection sensor 62A to the traveling device to drive the drive wheels according to the traveling operation information, and when the limit switch 14G detects that the armrest 14 is at the non-operation position, the VCM 41 controls the traveling device such that the traveling device does not drive the drive wheels even if the traveling operation is performed.

In this way, for example, in a case where the operator performs the traveling operation while the armrest 14 of the forklift 1 is flipped up and is at the non-operation position, the forklift 1 cannot be traveled, and therefore, safety can be improved.

(9) The VCM 41 of the forklift 1 does not transmit the traveling operation information to the traveling device such that the traveling device does not drive the drive wheels even if the traveling operation is performed, and therefore, it is possible to appropriately prohibit the traveling operation.

In a case where a configuration is made such that regenerative brake is applied at the time of non-drive, when the armrest 14 is flipped up to the non-operation position during traveling, it is possible to appropriately decelerate and stop the forklift 1.

(10) In the forklift 1, the safety bar 16 provided in front of the driver's seat 15 and protruding toward the driver's seat 15 is disposed at a space position higher than the seat surface of the driver's seat 15. In this way, the safety bar 16 is present at the space position where the steering wheel is disposed in the counterbalance type forklift of the related art, and therefore, for example, when the forklift 1 falls, the operator can grasp the safety bar 16 and secure his/her body.

(11) The armrest 14 of the driver's seat 15 of the forklift 1 is made so as to support the operator's body when the forklift 1 falls sideways. In this way, when the forklift 1 falls sideways, the operator's body can be reliably supported.

(12) The forklift 1 described above adopts the steering-by-wire type steering device (the fourth power conversion device 46, the steering motor M4, the gearbox 24, the Ackermann link mechanism 25, the rear wheels 22L and 22R) and is made so as to perform the steering operation by the mini-steering 14A provided, for example, on the left side different from the front of the operator seated in the driver's seat 15, and the safety bar 16 is provided in front of the driver's seat 15. That is, the forklift 1 includes: the mini-steering 14A that is provided at a location other than the front of the operator seated in the driver's seat 15 and outputs the operation signal in response to the steering operation; the steering device that changes the steering angle of the steering wheels of the forklift 1; the VCM 41 that electrically transmits the operation signal from the mini-steering 14A to the steering device to change the steering angle according to the operation signal; and the safety bar 16 provided in the front, protruding toward the driver's seat 15, and disposed at a space position higher than the seat surface of the driver's seat 15.

In the forklift 1 of the above embodiment, the front visibility of the operator is improved as compared with a case where the steering wheel is provided in front of the driver's seat 15.

On the other hand, since the steering wheel is not present in front of the driver's seat 15, when the forklift 1 falls forward, the operator cannot grasp the steering wheel to support his/her body. However, the safety bar 16 is provided in front of the driver's seat 15, whereby the operator can grasp the safety bar 16 to support his/her body, and thus safety can be improved.

The following modifications are also within the scope of the present invention, and one or more of the modification examples can also be combined with the embodiment described above.

Modification Example 1

In the description of the above embodiment, the example has been described in which in a case where all the three conditions: (Condition 1) the armrest 14 is located at the use position, (Condition 2) the operator is seated in the driver's seat 15, and (Condition 3) a seat belt (not shown) provided at the driver's seat 15 is locked, are satisfied, all of the traveling operation, the cargo handling operation, and the steering operation described above are permitted, and in a case where at least one of the three conditions is not satisfied, interlock is applied, so that all of the traveling operation, the cargo handling operation, and the steering operation are prohibited. The operations which are prohibited by the interlock may be limited to some of operations of traveling, cargo handling, and steering.

Modification Example 2

Further, in a case where some of the three conditions: (Condition 1) the armrest 14 is located at the use position, (Condition 2) the operator is seated in the driver's seat 15, and (Condition 3) a seat belt (not shown) provided at the driver's seat 15 is locked, for example, all the two conditions: (Condition 1) and (Condition 2), are satisfied, the traveling operation, the cargo handling operation, and the steering operation described above are permitted, and in a case where at least one of the two conditions is not satisfied, the interlock may be applied. In this manner, a configuration is made such that the conditions which are used for determining whether or not to apply the interlock can be changed according to, for example, the usage status of the forklift 1.

The conditions which are used for determining whether or not to apply the interlock may not only be decreased from the above three conditions but also be increased to four or five conditions by adding new conditions in addition to the above three conditions.

Modification Example 3

In the embodiment described above, the example has been described in which the interlock is applied by distinguishing between the traveling interlock in which interlock is applied with the traveling operation in a state where a condition is not satisfied as a trigger, the cargo handling interlock in which interlock is applied with the cargo handling operation in a state where a condition is not satisfied as a trigger, and the steering interlock in which interlock is applied with the steering operation in a state where a condition is not satisfied as a trigger. Instead, the interlock may be applied without distinguishing which operating serves as a trigger. In Modification Example 3, the VCM 41 applies interlock with any of the traveling operation, the cargo handling operation, and the steering operation as a trigger, in a state where a condition is not satisfied. While the interlock is applied, the VCM 41 prohibits all of the traveling operation, the cargo handling operation, and the steering operation described above.

Modification Example 4

In the embodiment described above, the example has been described in which the VCM 41 outputs the first control signal S1 to the first power conversion device 43 in a case where the traveling operation is performed in a state where the interlock is released, and in the interlock state, the VCM 41 does not output the first control signal S1 even if the traveling operation is performed.

Instead, the VCM 41 may control the accelerator stroke sensor 65A and the position detection sensor 62A such that in the interlock state, the accelerator stroke sensor 65A and the position detection sensor 62A do not output the detection signal of the traveling operation information even if the traveling operation is performed.

Similarly, the VCM 41 may control the lift detection sensor 63A and the tilt detection sensor 64A such that in the interlock state, the lift detection sensor 63A and the tilt detection sensor 64A do not output the detection signal of the cargo handling operation information even if the cargo handling operation is performed.

Furthermore, the VCM 41 may control the mini-steering 14A such that in the interlock state, the mini-steering 14A does not output an operation signal even if the steering operation is performed.

Modification Example 5

In the above description, a fully electric type has been exemplified as the steering-by-wire type steering device. However, a configuration using a hydraulic cylinder may be adopted. In Modification Example 5, for example, the fourth power conversion device 46 supplies electric power corresponding to the fourth control signal to an electric motor for steering (not shown) to control the rotation speed thereof. The rotary motion of the electric motor for steering is converted into a linear motion by a hydraulic actuator (not shown). Then, the left and right rear wheels 22L and 22R, which are the steering wheels, are steered by a hydraulic cylinder connected to the hydraulic actuator.

Modification Example 6

In the above description, the forklift 1 having a four-wheel configuration in which the steering wheels are configured with two left and right wheels has been exemplified.

However, a forklift having a three-wheel configuration in which the steering wheel is configured with one wheel nay be adopted.

Modification Example 7

Further, the forklift 1 described above is exemplified to have a configuration in which a motor is used as a power source for the traveling operation and the cargo handling operation. However, a configuration may be adopted in which an engine is used as the power source for the traveling operation or the cargo handling operation.

Modification Example 8

In the above description, the forklift 1 has been described as an example. However, as long as it is a steering-by-wire type industrial vehicle, it may not be limited to a forklift.

In the above, various embodiments and modification examples have been described. However, the present invention is not limited to these contents. Aspects in which each configuration shown in the embodiments and modification examples are used in combination are also included in the scope of the present invention. Other aspects conceivable within the scope of the technical idea of the present invention are also included within the scope of the present invention.

INDUSTRIAL APPLICABILITY

According to the forklift according to the present invention, the front visibility can be improved and safety can be secured.

REFERENCE SIGNS LIST

1: Forklift
2: Traveling wheel
3: Driver's cab
5: (second power conversion device 44, lift motor M2, hydraulic actuator 51, lift cylinder 12, third power conversion device 45, tilt motor M3, hydraulic actuator 52, and tilt cylinder 13) Cargo handling device
14: Armrest
14A: Mini-steering
14G: Limit switch
15: Driver's seat
15A: Seating sensor
16: Safety bar
41: VCM
(first power conversion device 43, traveling motor M1, differential device 23, front wheels 21L and 21R) Traveling device
(fourth power conversion device 46, steering motor M4, gearbox 24, Ackermann link mechanism 25, rear wheels 22L and 22R) Steering device

What is claimed is:

1. A forklift comprising:

an armrest that is provided at a driver's seat of a vehicle and is moved between a non-operation position and an operation position by a movable mechanism;

a steering member that is provided on the armrest and outputs an operation signal in response to a steering operation;

a steering device that is configured to change a steering angle of steering wheels of the vehicle;

a control unit that is configured to electrically transmit the operation signal from the steering member to the steering device to change the steering angle according to the operation signal;

an armrest detection unit that is configured to detect whether the armrest is at the non-operation position or at the operation position;

a cargo handling information output unit that is configured to output cargo handling operation information in response to a cargo handling operation;

a cargo handling device that is configured to drive a fork, based on the cargo handling operation information;

a traveling information output unit that is configured to output traveling operation information in response to a traveling operation; and a traveling device that is configured to drive drive wheels of the vehicle, based on the traveling operation information, wherein when the armrest detection unit detects that the armrest is at the non-operation position, the control unit controls the steering device or the steering member such that the steering device does not change the steering angle even if the steering member is operated, the control unit electrically transmits the cargo handling operation information from the cargo handling information output unit to the cargo handling device to drive the fork according to the cargo handling operation information, and when the armrest detection unit detects that the armrest is at the non-operation position, the control unit controls the cargo handling device or the cargo handling information output unit such that the cargo handling device does not drive the fork even if the cargo handling operation is performed, and the control unit electrically transmits the traveling operation information from the traveling information output unit to the traveling device to drive the drive wheels according to the traveling operation information, and when the armrest detection unit detects that the armrest is at the non-operation position, the control unit controls the traveling device or the traveling information output unit such that the traveling device does not drive the drive wheels even if the traveling operation is performed.

2. The forklift according to claim 1, wherein the armrest detection unit detects a first position where the armrest supports an arm of an operator as the operation position, and detects a second position different from the first position as the non-operation position.

3. The forklift according to claim 1, wherein when the armrest detection unit detects that the armrest is at the non-operation position, the control unit controls the steering member so as not to transmit the operation signal to the steering device or output the operation signal, such that the steering device does not change the steering angle.

4. The forklift according to claim 1, further comprising:

a seating detection unit that is configured to detect whether or not an operator is seated in the driver's seat, wherein when the seating detection unit detects that the operator is not seated, the control unit controls the steering member so as not to transmit the operation signal to the steering device or output the operation signal, such that the steering device does not change the steering angle even if the armrest detection unit detects that the armrest is at the operation position and the steering member is operated.

5. The forklift according to claim 1, wherein the cargo handling information output unit outputs the cargo handling operation information in response to a lifting operating or a tilting operating.

6. The forklift according to claim 1, wherein the control unit controls the cargo handling information output unit so as not to transmit the cargo handling operation information to the cargo handling device or output the cargo handling operation information, such that the cargo handling device does not drive the fork even if the cargo handling operation is performed.

7. The forklift according to claim 1, wherein the control unit controls the traveling information output unit so as not to transmit the traveling operation information to the traveling device or output the traveling operation information, such that the traveling device does not drive the drive wheels even if the traveling operation is performed.

8. The forklift according to claim 1, wherein a handrail provided in front of the driver's seat and protruding toward the driver's seat is disposed at a space position higher than a seat surface of the driver's seat.

9. The forklift according to claim 1, wherein the armrest supports an operator's body when the vehicle falls sideways.

10. The forklift according to claim 1, wherein in a case where the armrest is flipped up to the non-operation position during traveling, the forklift is decelerated and stopped by a regenerative brake.

11. The forklift according to claim 1, wherein the forklift is a counterbalance type.

* * * * *